US009790014B2

(12) United States Patent
Pilzecker

(10) Patent No.: US 9,790,014 B2
(45) Date of Patent: Oct. 17, 2017

(54) FLOWPACK TRAY

(71) Applicant: Amcor Flexibles, Kreuzlingen (CH)

(72) Inventor: Jens Pilzecker, Bückeburg (DE)

(73) Assignee: Amcor Flexibles, Kreuzlingen (CH)

( * ) Notice: Subject to any disclaimer, the term of this patent is extended or adjusted under 35 U.S.C. 154(b) by 0 days.

(21) Appl. No.: 14/433,829

(22) PCT Filed: Aug. 28, 2013

(86) PCT No.: PCT/EP2013/067816
§ 371 (c)(1),
(2) Date: Apr. 6, 2015

(87) PCT Pub. No.: WO2014/056658
PCT Pub. Date: Apr. 17, 2014

(65) Prior Publication Data

US 2015/0251833 A1 Sep. 10, 2015

(30) Foreign Application Priority Data

Oct. 8, 2012 (EP) ..... 12187604

(51) Int. Cl.

| | |
|---|---|
| ***B65D 83/08*** | (2006.01) |
| ***B65D 77/00*** | (2006.01) |
| ***B65D 65/38*** | (2006.01) |
| ***B65D 71/08*** | (2006.01) |
| ***B65D 77/38*** | (2006.01) |

(52) U.S. Cl.
CPC ..... *B65D 77/003* (2013.01); *B65D 65/38* (2013.01); *B65D 71/08* (2013.01); *B65D 77/38* (2013.01); *B65D 2571/00672* (2013.01)

(58) Field of Classification Search
CPC B65D 51/228; B65D 51/18; B65D 2517/001; B65D 83/08
USPC ..... 206/484, 497, 557, 494; 220/255.1, 255
See application file for complete search history.

(56) References Cited

U.S. PATENT DOCUMENTS 2,461,660 A * 2/1949 Salfisberg ..... B65D 75/20 206/484
4,548,852 A * 10/1985 Mitchell ..... B65D 21/08 206/497
5,141,795 A 8/1992 Kai et al.
5,375,698 A * 12/1994 Ewart ..... A45C 11/005 206/205
5,460,838 A * 10/1995 Wermund ..... B65D 75/58 383/35
5,647,506 A * 7/1997 Julius ..... A47K 10/421 206/449
6,056,141 A * 5/2000 Navarini ..... B32B 27/06 220/269

(Continued)

FOREIGN PATENT DOCUMENTS

WO WO 2008/086388 A1 7/2008

*Primary Examiner* — King M Chu
(74) *Attorney, Agent, or Firm* — Reinhart Boerner Van Deuren P.C.

(57) ABSTRACT

The present invention is related to a flowpack comprising a cross-sealed film, said film comprising one or more polymeric layer(s), said flowpack enclosing a tray comprising one or more cavity(ies), the film forming said flowpack being sealed against said tray and forming a lid closing the cavity(ies) of said tray, said lid being part of the initial film of the flowpack.

10 Claims, 2 Drawing Sheets

(56) References Cited

U.S. PATENT DOCUMENTS

| | | | | | |
|---|---|---|---|---|---|
| 6,164,441 | A * | 12/2000 | Guy | ..... | B65D 75/5838<br>206/210 |
| 2005/0000965 | A1 * | 1/2005 | Boardman | ..... | B65D 65/466<br>220/359.1 |

* cited by examiner

FLOWPACK TRAY

FIELD OF THE INVENTION

The present invention is related to a flowpack comprising a tray.

STATE OF THE ART

Packaging comprising a tray with one or more cavity(ies) closed by a lidding film are known in the art. The tray is usually produced by thermoforming a polymeric monolayer or a multiple layer film in a mould comprising one or more cavity(ies). Alternatively, such a tray can be performed by injection moulding.

Both thermoforming and injection moulding induce strong limitations in the performance of the tray. For example, films comprising an absolute barrier layer, such as a metallic layer or a metal oxide layer, cannot be thermoformed without losing the barrier properties. Technically speaking, such an absolute barrier layer can be added on the formed trays, but the complexity and cost of depositing such layers on three-dimensional structures limit their use to very specific applications.

Furthermore, those processes also exclude the use of pre-printed films, and printing the entire 3D structure is difficult.

For those reasons, tray/lidding packages comprising one or more cavity(ies) are usually overwrapped by a secondary package, this secondary package offering the possibilities of printed surfaces and/or barrier properties that are usually not available on a tray.

WO 2008/086388 A1 discloses a flowpack comprising a tray, wherein the cavities of the tray are closed by a separate label that is not part of the initial flowpack film.

The use of secondary packaging should nevertheless be avoided in order to globally reduce the packaging waste.

SUMMARY OF THE INVENTION

The present invention discloses a flowpack comprising a cross-sealed film, said film comprising one or more polymeric layer(s), said flowpack enclosing a tray comprising one or more cavity(ies), the film forming said flowpack being sealed against said tray and forming the lid closing the cavity(ies) of said tray, said lid being part of the initial film of the flowpack.

Preferred embodiments of the present invention disclose at least one or a suitable combination of the following features:

- The tray is a multiple-cavity tray;
- the film forming the flowpack comprises weakened lines, said weakened lines allowing, in use, the individual opening of each of said one or more cavity(ies);
- the cross-seals of the flowpack are cold seals;
- the seal of the multiple-cavity tray on the film forming the flowpack is a heat seal;
- the flowpack comprises a fin seal in addition to the cross-seals;
- the film is a multiple-layer film selected from the group consisting of heat-seal lacquer/PET/print layer/PE, or OPP/print layer/PE, or OPP/print layer/OPP, or print layer/OPP/metalized-OPP/seal layer or print layer/OPP/seal layer;
- the flowpack is label-free.

The flowpack of the invention can be produced by a process comprising the steps of:

- providing a tray comprising one or more cavity(ies);
- filling the cavity(ies) with goods to be packaged;
- providing a flowpack having at least one unsealed end;
- placing the filled tray in the flowpack;
- closing the at least one unsealed end of the flowpack by means of a cross-seal;
- sealing the flowpack on said tray for closing the cavity (ies), the flowpack thereby forming a lid closing the tray.

Advantageously, the step of providing a flowpack is performed by producing the flowpack around the filled tray on an horizontal form fill seal (HFFS) machine.

Alternatively, the flowpack of the invention can be produced by a process comprising the steps of:

- providing a tray comprising one or more cavity(ies);
- filling the cavity(ies) with goods to be packaged;
- sealing a lidding film on said tray for closing the cavity (ies);
- folding both sides of the lidding film hanging out of the tray and sealing them by a fin seal or a lap seal;
- cutting and cross-sealing both ends of the formed flowpack.

KEYS

Figure 1:
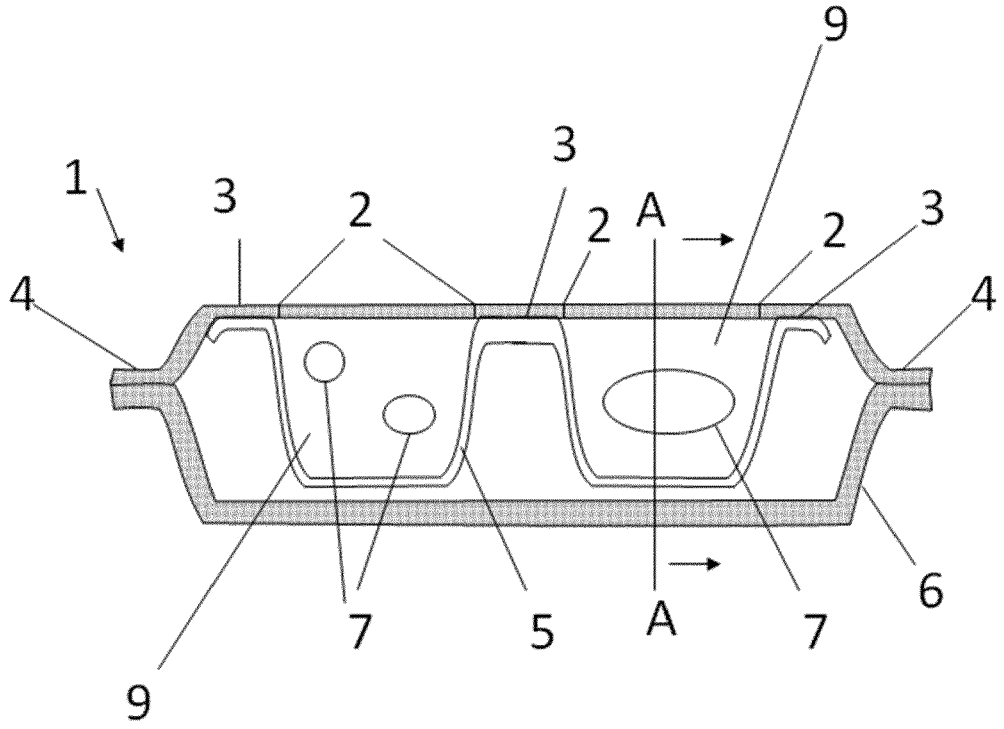
FIG. 1 represents a cross-section of a multiple-cavity flowpack according to one embodiment of the invention.
Figure 2:
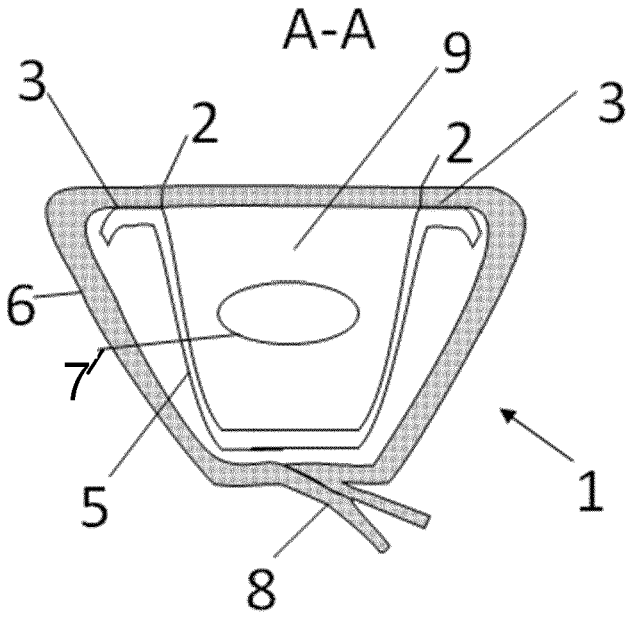
FIG. 2 represents the cross-section of a multiple-cavity flowpack of FIG. 1 along the A-A plane.
Figure 3:
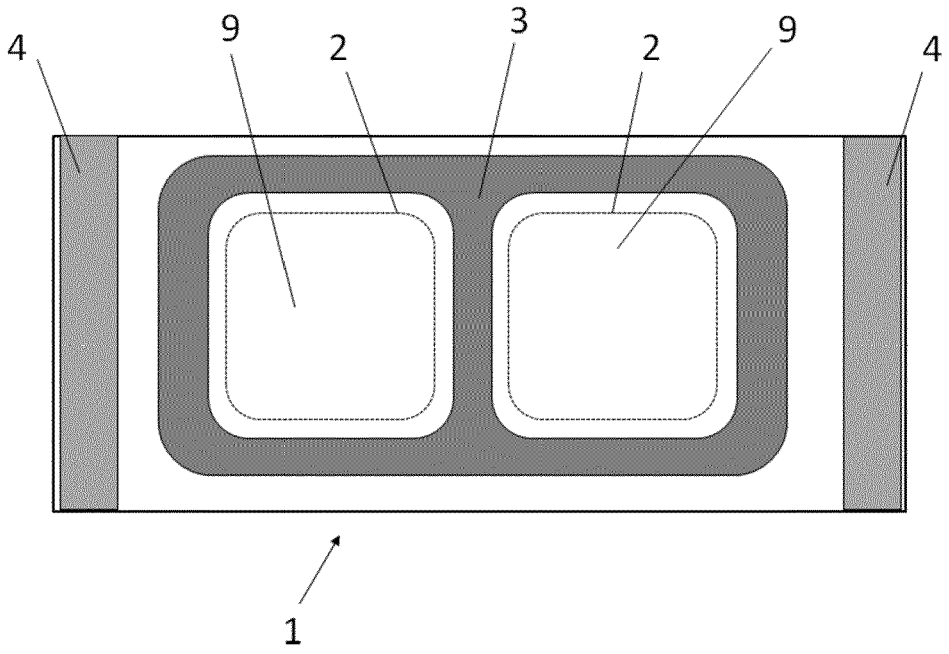
FIG. 3 represents a top view of a multiple-cavity flowpack according to one embodiment of the invention.

1: multiple-cavity flowpack
2: weakened line
3: seal between tray and film
4: cross-seal
5: multiple-cavity tray
6: film forming the flowpack (used as lidding film closing the multiple-cavity tray) in FIG. 1
7: packaged goods
8: fin seal
9: cavity

DETAILED DESCRIPTION OF THE INVENTION

The present invention is related to a flowpack 1 enclosing a tray 5 comprising one or more cavity(ies), the film 6 forming said flowpack 1 being sealed against said tray 5 and forming a lid closing the individual cavity(ies) 9, said lid being part of the initial film of the flowpack.

Such flowpack 1 presents several advantages in comparison with prior-art tray packaging. As a first advantage, there is no need for a secondary packaging, as the flowrap film 6 completely encloses the tray 5.

As a further advantage, the flowpack 1 of the invention can be easily produced on modified horizontal form fill and seal machines or thermoform fill seal machines.

For example, filled trays can be fed to an horizontal form fill seal machine, wherein the flowpack 1 is formed and sealed around the filled tray, the inner surface of the flowpack 1 being sealed in a subsequent step on the top surface of the tray, thereby closing the individual cavities.

Alternatively, it is also possible to modify a thermoform fill seal (TFFS) process to produce the flowpack of the invention. In that case, a bottom film is fed to the modified TFFS machine, thermoformed in a tray mould comprising one or more cavity(ies) and cut into the desired dimensions. Alternatively, a tray 5 can be directly fed to the machine.

The goods 7 to be packed are then distributed in the cavity(ies) 9, and the film 6 forming the flowpack 1 is sealed onto the upper surface of the tray, as a lidding would be sealed on a tray 5 in standard thermoform fill and seal processes or in a tray/lidding process, the sole difference being that the film 6 is wider than the tray 5, so that it can be subsequently folded and cross-sealed for forming the flowpack 1.

On a further station known from horizontal form fill and seal machines, the film 6 can be folded and sealed under the tray by means of a fin seal 8 or a lap seal.

A last station also known from horizontal form fill and seal machines seal and cut the cross-seals 4 to close the flowpacks 1.

Such a process simplifies the general process known in the prior art, as usually the secondary packaging is added on a separate device.

In order to ease the individual opening of the cavities 9, the film 6 forming the flowpack 1 preferably comprises weakened lines 2 crossing the cavities. Advantageously, said weakened lines 2 are located around the top of the cavities 9. Such weakened lines 2 can be for example produced by laser scoring at the lidding-sealing station. Alternatively, the weakened lines 2 can be produced on the film before the packing process. In that case, optical marks are preferably present on the film 6 in order to have the weakened lines 2 correctly positioned with regard to the cavities 9.

Preferably, the transverse seals 4 and the fin seal 8 or lap seal are cold seals.

Advantageously, the seal between the tray and the film forming the flowpack 1 is a heat seal.

Typical film-tray compositions are monolayer thermoformed or moulded trays comprising polyester or polyolefins such as PET, PETG or a-PET, PP, or HDPE. Optionally the tray can be a multilayer tray comprising a sealant layer.

Suitable flowpack/lidding films are selected from the group consisting of:

heat-seal lacquer/PET/print layer/PE,
OPP/print layer/PE,
OPP/print layer/OPP,
print layer/OPP/metalized-OPP/seal layer,
print layer/OPP/seal layer.

The invention claimed is:

1. A flowpack comprising:
a flowpack body comprising:
a film of at least one polymeric layer;
a longitudinal seal;
a first and a second cross-seal;
a tray;
the tray comprising a bottom wall and at least one outer wall, the at least one outer wall surrounding an outermost perimeter of the bottom wall and extending from the bottom wall towards a top of the tray to define an at least one cavity;
wherein the flowpack body encloses the tray with the film of the flowpack body sealed against the top of the tray to form a lid closing the at least one cavity.

2. The flowpack of claim 1, wherein the at least one cavity is comprised of a plurality of the at least one cavity.

3. The flowpack of claim 1, wherein, the film forming the flowpack body comprises at least one weakened line, said at least one weakened line allowing, in use, the opening of the at least one cavity.

4. The flowpack of claim 1, wherein the first and the second cross-seal of the flowpack body are cold seals.

5. The flowpack of claim 1, wherein the seal for the lid sealed against a top of the tray to close the at least one cavity is a hot seal.

6. The flowpack of claim 1, further comprising a fin seal.

7. The flowpack of claim 1, wherein the film of at least one polymeric layer comprises a plurality of layers, the plurality of layers selected from the group consisting of heat-seal lacquer/PET/print layer/PE, or OPP/print layer/PE, or OPP/print layer/OPP, or print layer/OPP/metalized-OPP/seal layer or print layer/OPP/seal layer.

8. The flowpack of claim 1, wherein the flowpack body is label-free.

9. The process for the production of the flowpack comprising the steps of:
providing a tray comprising a bottom wall and at least one outer wall, the at least one outer wall surrounding an outermost perimeter of the bottom wall and extending from the bottom wall towards a top of the tray to define an at least one cavity
filling the at least one cavity with goods to be packaged;
forming a flowpack body with a film of at least one polymeric layer having a longitudinal seal and a first cross seal and an unsealed end;
placing the tray having the filled at least one cavity in the flowpack through the unsealed end; closing the unsealed end of the flowpack body with a second closing seal;
forming a lid from the flowpack body upon the tray to close the at least one cavity by sealing the at least one polymeric film to a top surface of the tray.

10. The flowpack of claim 2, wherein the film forming the flowpack body comprises a plurality of weakend lines, each one of the plurality of weakend lines allowing, in use, the opening of a one of the plurality of the at least one cavity.

* * * * *